US009167904B2

(12) United States Patent
McDonnell

(10) Patent No.: US 9,167,904 B2
(45) Date of Patent: Oct. 27, 2015

(54) PORTABLE ARM REST

(76) Inventor: Joseph A. McDonnell, Weston, FL (US)

( * ) Notice: Subject to any disclaimer, the term of this patent is extended or adjusted under 35 U.S.C. 154(b) by 974 days.

(21) Appl. No.: 12/656,585

(22) Filed: Feb. 4, 2010

(65) Prior Publication Data

US 2011/0186698 A1 Aug. 4, 2011

(51) Int. Cl.

| | |
|---|---|
| ***B68G 5/00*** | (2006.01) |
| ***A47C 7/54*** | (2006.01) |
| ***A47C 7/68*** | (2006.01) |
| *A47C 7/62* | (2006.01) |

(52) U.S. Cl.

CPC . *A47C 7/546* (2013.01); *A47C 7/68* (2013.01); *A47C 7/62* (2013.01)

(58) Field of Classification Search

CPC ..... G06F 3/0395; B60N 2/4666; A47C 7/62

USPC ..... 297/188.14, 188.01, 188.2, 188.19, 297/411.23, 411.24, 411.46, 183.1, 183.5; 248/118.5, 118, 313, 451, 447.2

See application file for complete search history.

(56) References Cited

U.S. PATENT DOCUMENTS

| | | | | |
|---|---|---|---|---|
| 4,062,077 | A * | 12/1977 | Autrey et al. | 5/668 |
| 4,858,995 | A * | 8/1989 | Young | 297/411.23 |
| 4,896,388 | A * | 1/1990 | Bard | 5/644 |
| 5,234,251 | A * | 8/1993 | Ayotte | 297/188.14 |
| 5,632,051 | A * | 5/1997 | Stanley et al. | 5/636 |
| 5,884,879 | A | 3/1999 | Gruenenfelder | |
| 5,911,472 | A | 6/1999 | Toth | |
| 6,371,641 | B1 | 4/2002 | Wilson, Jr. | |
| 6,827,405 | B1 | 12/2004 | Roberts | |
| 7,165,808 | B2 | 1/2007 | Harland et al. | |
| 7,334,838 | B2 | 2/2008 | Pope | |
| 7,448,675 | B1 * | 11/2008 | Lowery | 297/188.14 |
| 7,585,021 | B2 | 9/2009 | Tabata | |

OTHER PUBLICATIONS

Search Report and Written Opinion dated May 2, 2011 issued in corresponding PCT Application No. PCT/US11/00202.

* cited by examiner

*Primary Examiner* — Kimberly Wood

(74) *Attorney, Agent, or Firm* — Bass, Berry & Sims, PLC

(57) ABSTRACT

A portable arm rest with a container holder and, more particularly, a portable arm rest having an flexible counterweight such an internal bladder that contains a material, such as a fluid, that both stabilizes the arm rest and readily conforms the arm rest to different uniform or undulating supporting surfaces.

3 Claims, 7 Drawing Sheets

PORTABLE ARM REST

FIELD OF THE INVENTION

The present invention relates generally to a portable arm rest with a container holder and, more particularly, to a portable arm rest having an flexible counterweight such an internal bladder that contains a material, such as a fluid, that both stabilizes the arm rest and readily conforms the arm rest to different uniform or undulating supporting surfaces.

BACKGROUND

Arm rests serve a variety of functions. An arm rest primarily provides support to a person's arm in an elevated position in a variety of environments. In many cases, this occurs while a person is sitting down, but is not limited to this circumstance.

Beyond merely supporting an arm, arm rests serve other functions such as holding one or more beverages. These beverage holders are generally cylindrical and are of a sufficient depth and width to accommodate most beverage container shapes. However, one of the primary problems with portable arm rests having beverage holders is maintaining the beverage in an upright position to avoid spillage when the portable arm rest is in use. The weight of a beverage container with its contents in a holder must be balanced against the weight of the supporting arm rest to ensure that the arm rest maintains the beverage in a stable and upright position. Otherwise, a beverage with its contents will make the arm rest top heavy and likely to turn over. In some cases, a single beverage holder may be positioned along the centerline of the upper surface of an arm rest in order to balance the weight of a container when held in the beverage holder with respect to body of the arm rest. In other cases, a beverage holder may be placed across the centerline of the arm rest so that the arm rest remains balanced. Neither of these functions alone are sufficient to prevent the arm rest from becoming unstable.

This problem becomes more difficult when the arm rest is used on an uneven and/or unstable surface that tends to cause the arm rest to tip over more readily when holding one or more beverages in response to the weight imbalance. In some cases, an arm rest is secured by a supporting structure or mechanism that holds the structure in a fixed position. However, this prevents the arm rest from being readily moved from one environment to another without undue effort. Most arm rests that are designed to be portable use have a planar shaped bottom surface that does not conform to uneven supporting surfaces such as a furniture cushion for a couch or car seat. This makes them further unstable and, as such, incapable of holding a beverage without the risk of turning over.

SUMMARY OF THE INVENTION

The present invention is directed to a portable arm rest having an elongated generally hollow member having a flexible outer surface; a substantially rectangular shaped foam member disposed in the generally hollow member and a fluid counterweight member disposed within the lower portion of the hollow member for holding the portable arm rest in a stable and upright position on both smooth and undulating surfaces. In one embodiment, the counterweight member is an elongated bag or bladder having a length that extends along a substantial portion of the length of the hollow member and that is capable of being filed with a fluid, such as water or gel, in order to distribute weight evenly along the lower surface of the portable arm rest for holding the arm rest in an upright position.

In one exemplary embodiment, the portable arm rest has a beverage holder or holders disposed on or formed in the upper surface of the hollow member, such that the weight of a beverage container or containers positioned in the beverage holder or holders is counter-balanced by the counterweight member so that the portable arm rest remains in an upright and stable position on both smooth and undulating surfaces.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The present invention will become more fully understood from the detailed description and the accompanying drawings, wherein.

DETAILED DESCRIPTION OF EXAMPLE EMBODIMENTS

Figure 1:
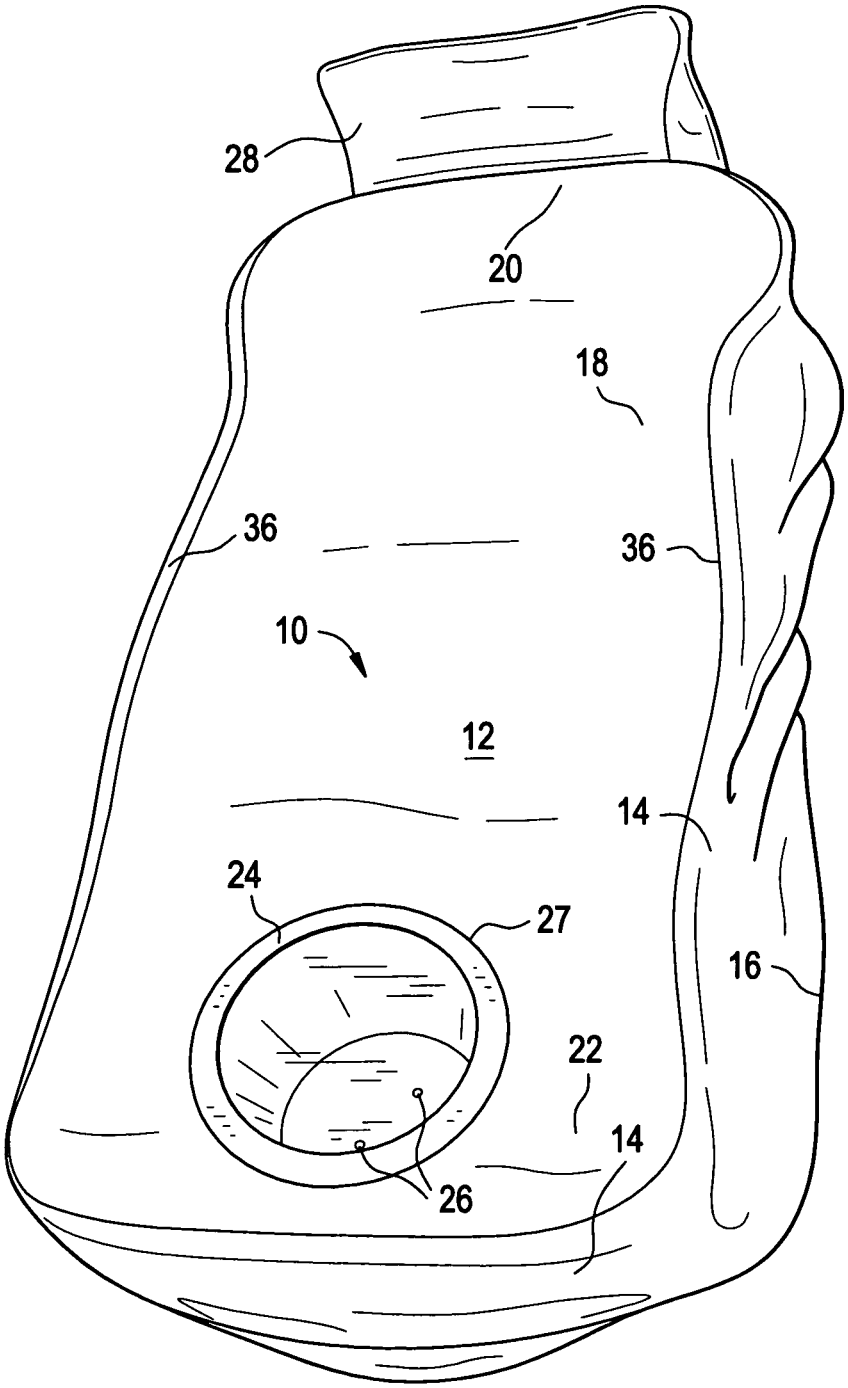
FIG. 1 is a perspective view illustrating a top portion of a portable arm rest in accordance with an embodiment of the invention.

Specific structural and functional details disclosed herein are merely representative for purposes of describing example embodiments of the present invention. This invention may, however, be embodied in many alternate forms and should not be construed as limited to only the embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the invention to the particular forms disclosed, but on the contrary, example embodiments of the invention are to cover all modifications, equivalents, and alternatives falling within the scope of the invention. As used herein, the term "and/or" includes any and all combinations of one or more of the associated listed items.

The terminology used herein is for the purpose of describing particular embodiments only and is not intended to be limiting of example embodiments of the invention. As used herein, the singular forms "a", "an" and "the" are intended to include the plural forms as well, unless the context clearly indicates otherwise. It will be further understood that the terms "comprises", "comprising,", "includes" and/or "including", if used herein, specify the presence of stated features, integers, steps, operations, elements, and/or components, but do not preclude the presence or addition of one or more other features, integers, steps, operations, elements, components, and/or groups thereof.

The invention will now be described with reference to the drawing figures, in which like reference numerals refer to like parts throughout.

An embodiment in accordance with the present invention provides a arm rest that is both portable and light weight. The arm rest may also be collapsible. The arm rest may be easily installed. However, in order to perform desired functions of an arm rest, the arm rest, in accordance with some embodiments, may also be robust enough to provide effective support for a person's arm. The arm rest may be resilient to provide a soft and comfortable surface yet sufficiently rigid to provide support. These features may be found in arm rests according to various embodiments described below.

FIG. 1 shows a perspective view of a portable arm rest 10 in accordance with one exemplary embodiment of the invention. The arm rest 10 includes a top surface 12, side surfaces 14, and a bottom surface 16 (not shown) that when assembled collectively define the cover 18. The cover 18 may be formed of any pliable material that is relatively durable while still capable of conforming to supporting surfaces. Suitable materials would include fabric, leather, or plastic, but other materials have similar characteristics may also be used. In some cases, the materials may also be treated to avoid spills and/or treated with anti-bacterial solution.

In this exemplary embodiment, the arm rest 10 includes a forward end 20 and rearward end 22. In other embodiments, the arm rest 10 may be used regardless of orientation. An optional beverage holder 24 may be located near the forward end 22 near the center line of the arm rest 10. While one beverage holder is shown, multiple beverage holders may be positioned along the upper surface of the arm rest 10 for holding the beverages in the one or multiple beverage container holders so that the beverages are maintained in a substantially upright position. The depth, width and height of each beverage holder 24 is dimensioned to receive and support a variety of beverages containers. In one embodiment, the beverage holder 24 may be designed to hold a circular container of an average size. However, both fixed and adjustable beverage holders may be used that accommodate a variety of shape and size containers. In the embodiment shown, the beverage holder may be a preformed insert made of semi-rigid plastic, metal or other similar material that may be manually inserted into the cover 18 and foam support member. In other embodiments, the beverage holder may be affixed to foam support member or integrally formed with the cover and or a foam support member (discussed below).

Figure 6:
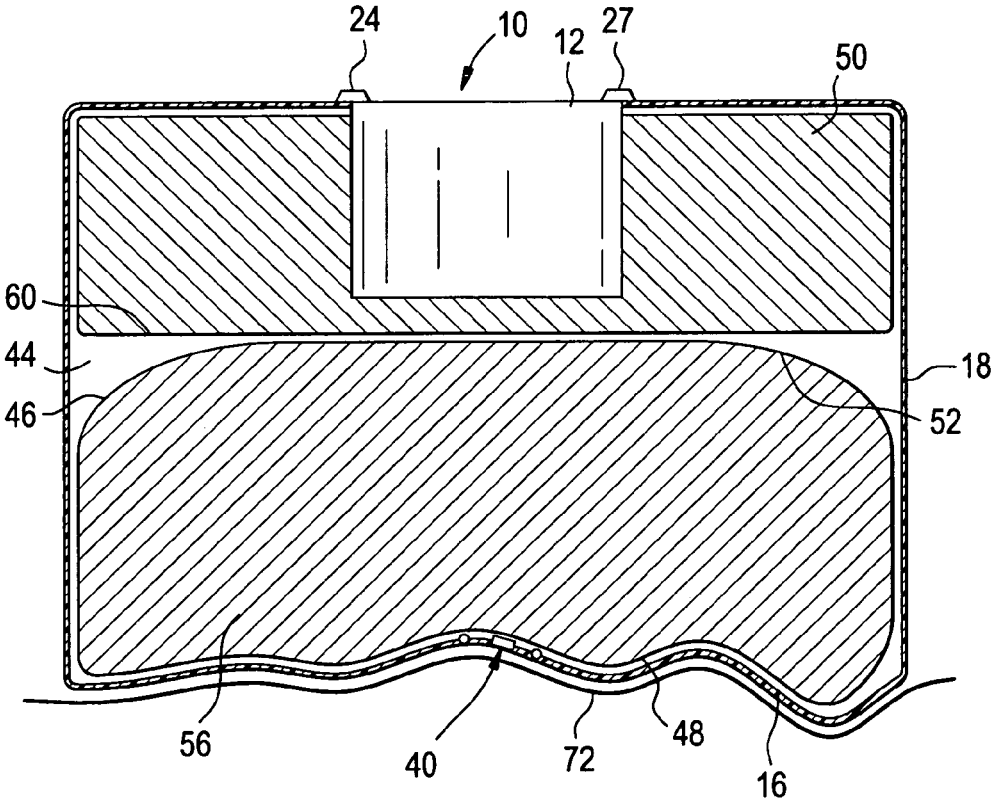
FIG. 6 is a cross-section view of an arm rest in accordance with the invention.

As also shown in FIG. 1, the beverage holder 24 includes a flanged portion 27 and a cylindrical body for receiving a beverage. The beverage holder 24 is positioned within an aperture in the upper surface of the cover near the centerline of the portable arm rest 10 and extends within the interior of the cover. By positioning the beverage holder 24 at or near the center line of the portable arm rest, the weight of a container with its contents are more balanced and the arm rest is less likely to tip over. As shown in FIG. 6, the beverage holder 24 is received and supported by a rectangular shaped elongated support member formed, in one exemplary embodiment, from flexible rubber foam. The foam support member extends substantially along the length of the cover to fill the upper portion of the upper interior portions of the cover 18 to give shape to the arm rest. The foam support member is also sufficiently pliable to cushion and support a user's arm while maintaining the structural integrity of the arm rest. In one exemplary embodiment, the shape of the foam support is contoured near the rearward ends on both sides to receive a user's body while supporting the user's arm in a central location near the center line. The foam support is contoured on both sides so that more that one person may use the arm rest at one time. While a form material is used in the exemplary embodiment, other similar materials may also be used.

Figure 2:
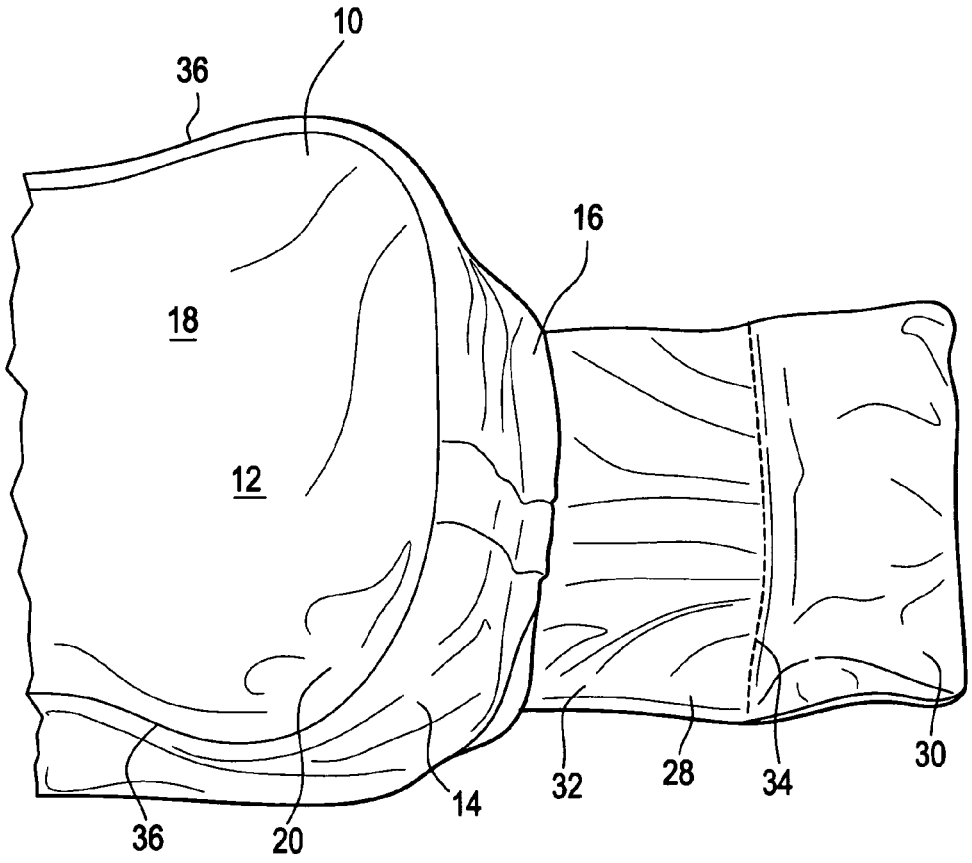
FIG. 2 is a partial perspective view of the arm rest shown in FIG. 1.

In one embodiment, an anchor 28 may be located at the rearward end of the arm rest 10. The anchor 28 may be made of the same or a similar material as the cover 18 or in other embodiments may be made of a different material. The anchor 28 may be positioned between the seat and back cushions of a car seat or furniture for restricting lateral and rotational movement of the arm rest 10 when in use. FIG. 2 shows a perspective view of the anchor 28. The anchor 28 may include a padded portion 30 and a flap portion 32. The padded portion 30 may be filled with material such as foam rubber, sand, beads or other material that allows the end to function as a stopper, like a knot at the end of a rope. The padded portion 30 may be separated from the flap portion 32 by stitching 34. The flap portion 32 and the padded portion 30 of the anchor 28 may be made of the same material as the cover 18. The flap portion 32 connects the padding portion 30 to an end 20 of the arm rest 10. The elbow pad 28 may be attached to the bottom surface 16 as shown in FIG. 2. In other embodiments the invention, the anchor 28 may be attached to the side surface 14 or the top surface 12.

Figure 3:
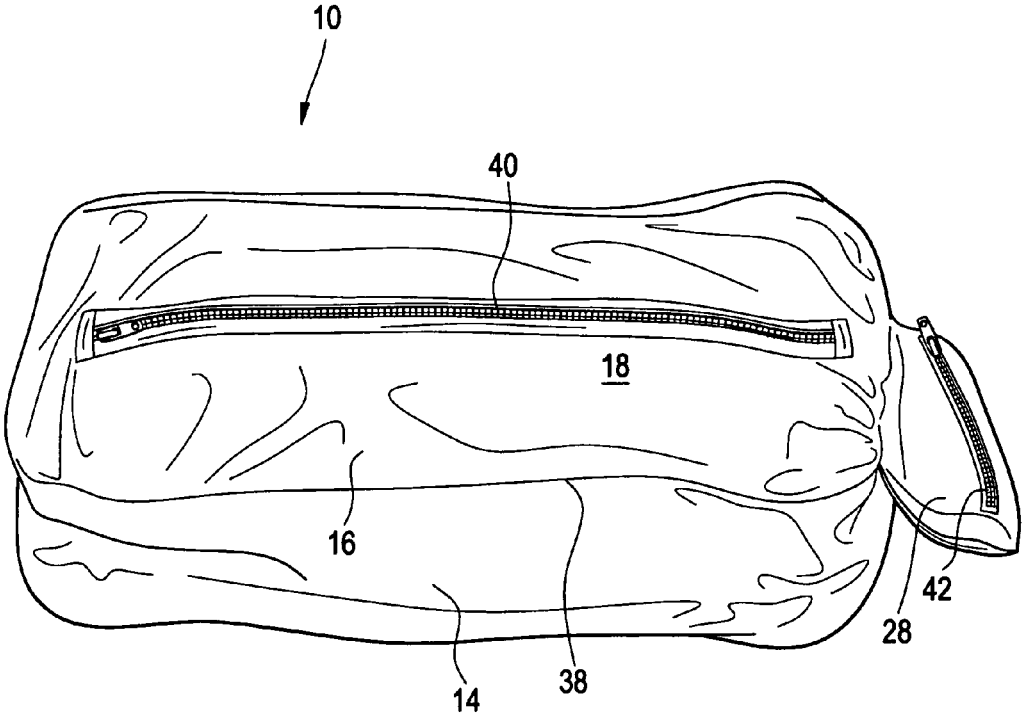
FIG. 3 is a perspective view of an underside of the arm rest shown in FIG. 1.

FIG. 3 shows a bottom perspective view of the arm rest 10. The arm rest 10 may also include an interior access port 40 that longitudinally extends along a substantial portion of the bottom surface of the arm rest 10. The interior access port 40 may permit access to the interior of the cover 18 for easily inserting and removing constituent elements from inside the cover 18. While the interior access port shown in FIG. 3 is a zipper, various embodiments of the invention may include various other types of materials or systems to provide a way to open and close an access port 40 to selectively allow access to the interior of the cover 18.

In some embodiments of the invention, the anchor 28 may also be equipped with an access port 42. While a zipper is shown in FIG. 3, the access port 42 on the anchor 28 may also include various other systems for providing selected access to the interior portion of the elbow pad 28 in accordance with the invention.

Figure 4A:
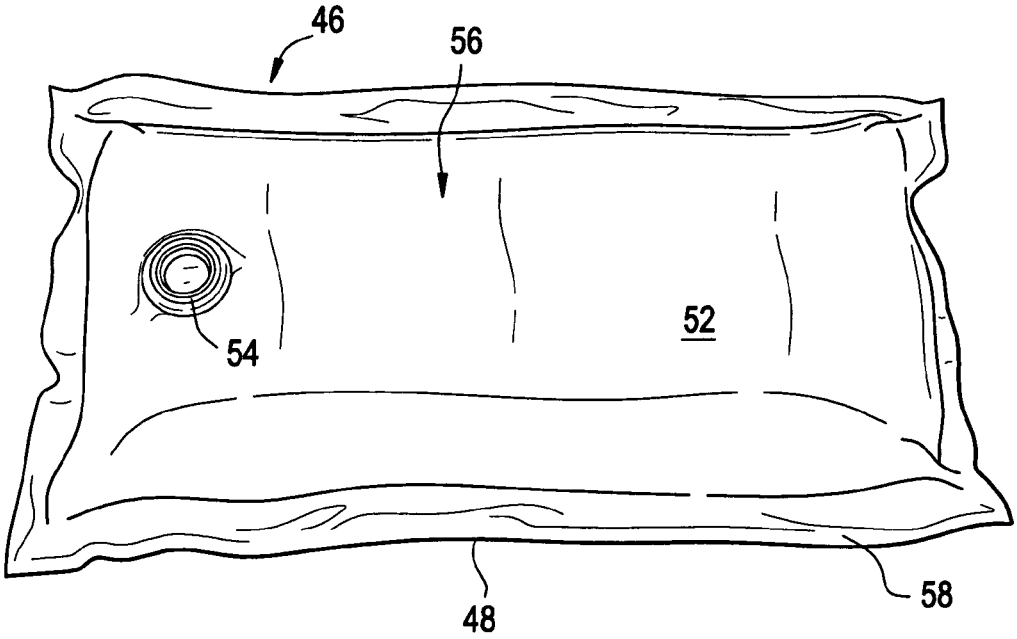
FIG. 4A is a perspective view of a pillow-shaped bladder which may be inserted into the interior portion of an arm rest.

FIG. 4A shows a flexible counterweight (or bladder 46) that is disposed inside the lower portion of the chamber 18 to hold the portable arm rest in an upright and stable condition, even when holding a beverage. The bladder 46 is designed to be filled with a fluid. When filled, the bladder 46 is positioned within the chamber 18 for distributing weight evenly along the bottom surface of the arm rest. Because the bladder 46 is filled with fluid, it assists in conforming the lower surface of the arm rest 10 to a supporting surface since the fluid within the bladder flows to evenly distribute weight against the flexible bladder and flexible cover as the cover abuts a supporting surface. When a beverage is placed in the beverage holder 24, the arm rest 10 may become top heavy and unstable as weight is repositioned along the top surface of the arm rest 10. Thus, the bladder 46 directing weight evenly along the bottom of the arm rest ensures stability when used both alone and in combination with the beverage holder 45 being positioned near the centerline of the arm rest 10 and the anchor 28 restricting movement of the arm rest.

In this example embodiment, the bladder 46 may be pillow-shaped. The length and width of the bladder 46 is designed to cover a substantial portion of the interior lower surface of the chamber 18 for positioning weight along the bottom surface. When disposed with the cover, the bladder 46 is sandwiched between the rectangular shaped foam rubber support and the cover to restrict movement of the bladder 46 within the chamber. By having a single chamber, the arm rest 10 is easy to assemble. Also, the bladder may be easily replaced if it becomes damaged. In one embodiment, the outside of the bladder 46 may have a coarse or protective surface to protect the bladder 46 from damage and to restrict movement of the bladder 46 with respect to the inner surface of the chamber. Other devices and methods may be used to secure the bladder.

The bladder 46 may include an access port 54. The access port 54, or part of the access port 54, may be removable. For example, in some embodiments, the access port 54 may include a lid that screws into the bladder 46. The access port 54, when in a closed position, is sealed to prevent fluid 56 from leaking from inside the bladder 46. The access port 54 may use any suitable system for selectively providing access to the interior of the bladder 46 and sealing the interior of the bladder 46.

In some embodiments of the invention, the fluid 56 contained within the bladder 46 is water. In other embodiments, the fluid 56 may be a gel or any other suitable fluid. The viscosity of fluid 56 must be sufficient to allow for free movement of the fluid within in the bladder 46 in order to evenly distribute the weight across the bottom of the arm rest while conforming to the supporting surface.

The bladder 46 may be easily drained of the fluid 56. Draining the fluid 56 from the bladder 46 allows the arm rest 10 to be lighter and collapsible into a more compact space for easy storage when not is use.

Figure 5:
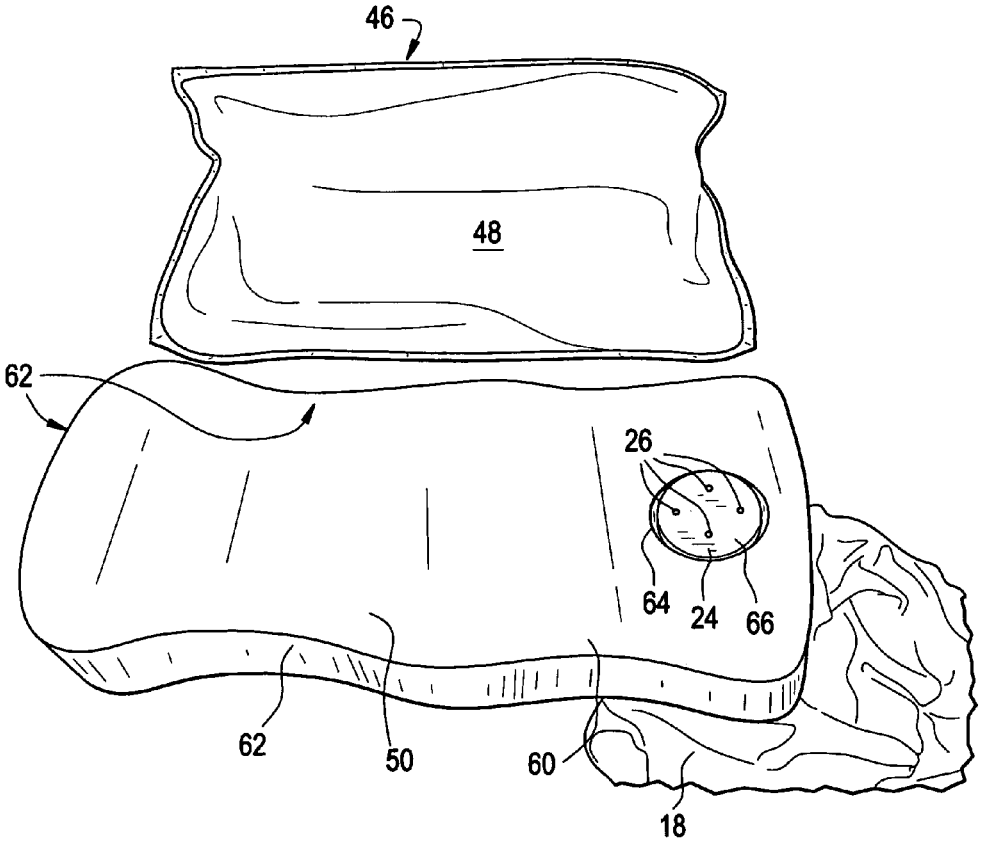
FIG. 5 is a perspective view of a foam pad and bladder which may be located inside the arm rest of FIG. 1.

According to some embodiments of the invention, the bladder 46 is made of a flexible, yet resilient, material that can maintain its structural integrity under the forces of supporting a user's arm while confining the fluid 56. In one embodiment, the bladder 46 may be made from a pliable plastic. Other materials may also be used. In one example, the bladder 46 may be entirely comprised of a translucent material with one translucent side 52 and a protective coating 48 placed on an opposing side as shown in FIG. 5. The protective coating 48 is optional. The length, width and height of the bladder 46 allow it to fit within the chamber while covering a substantial portion of the inner bottom surface of the arm rest 10. More specifically, the dimensions of the bladder 46 vary to evenly distribute a stabilizing weight based on the dimensions of the arm rest 10.

Figure 4B:
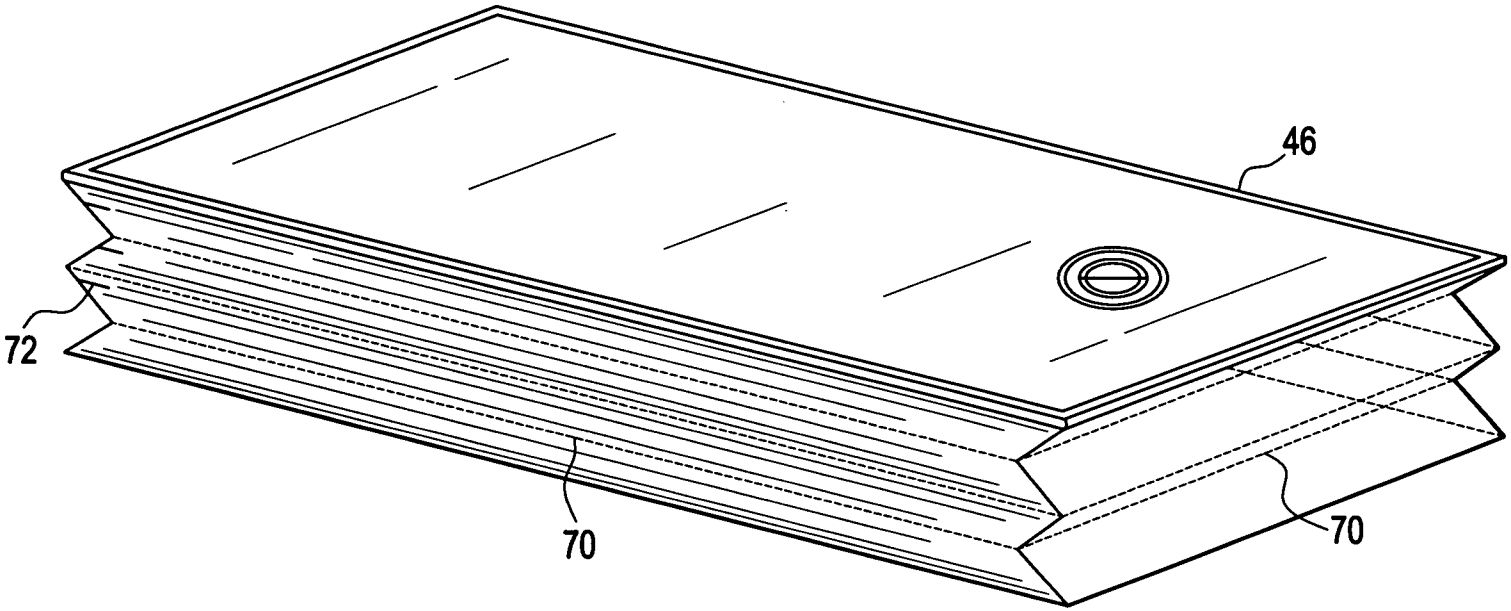
FIG. 4B is a perspective view of an accordion-shaped bladder which may be inserted into the interior portion of an arm rest.

As illustrated in FIG. 4B, another embodiment of the bladder 46 may be accordion-shaped so that a user may adjust the overall effective height of the arm rest by placing a predetermined amount of liquid into the bladder 46. The baffles 70 of the bladder 46 are arranged along the side, front and rear sides of the bladder 46 such that the top and bottom surfaces remain in a substantially parallel relationship as the user fills the bladder 46 with fluid. In the exemplary embodiment shown, a visual indicator 72 is disposed on one or more sides of the bladder 46 to monitor the amount of fluid introduced into the bladder 46. The visual indicator 72 is shown as a measuring scale or ruler in FIG. 4B where the various hash marks associate a fluid level with an overall height of arm rest 10 that is the approximate distance between the top and bottom surfaces of the arm rest 10. Other visual indicators may also be used.

FIG. 5 shows the foam pad 50 and bladder 46 removed from the interior chamber 44 defined by the cover 18. FIG. 5 shows that the bladder 46 may have the protective coating 48 covering a large portion of the bladder 46. In other embodiments the protective coating 48 may be localized to an area that may be subject to wear from the interior access port 40. As shown in FIG. 5, the cover 18 has been turned inside out in order to expose the foam pad 50. The surface 60 of the foam pad 50 contacts a foam side surface 52 of bladder 44 when the foam pad 50 and the bladder 46 are contained in the interior chamber 44 of the cover 18. The foam pad 50 is some respects defines the shape of the cover 18 when the foam pad 50 is placed within the interior chamber 44 of the cover 18. The foam pad 50 has contoured sides 62 which help define the contoured sides 36 in the arm rest 10 as shown in FIGS. 1 and 2.

The foam pad 50 may include a beverage holder receiving aperture 64 for receiving and supporting the beverage holder 24. In the orientation shown in FIG. 5 the underside 66 of the beverage holder 24 is shown. The beverage holder 45 shown in FIG. 5 has a plurality of vents disposed in the bottom of the holder to vent air when the beverage holder is secured within the aperture 64 and also to exhaust condensation from the bottom of the beverage holder 24 when in use. While a beverage holder 24 is shown to have four vents 26, the beverage holder 24 may have more, fewer, or no vents at all in accordance with some embodiments of the invention. As also shown in FIG. 5, the bladder 46 and the foam pad 50 are approximately the same width and length. However, the dimensions of foam pad 50 may be vary as compared to the bladder 46 in other embodiments so long as the weight of the bladder 46 is sufficient to stabilize the arm rest when used with the foam pad 50.

FIG. 6 shows a cross-section view of an example arm rest 10. The cover 18 forms an interior chamber 44. The foam pad 50 is located in the interior chamber 44 near the top surface 12 of the arm rest 10. The bladder 46 is located in the interior chamber 44 under the foam pad 50. The protective cover 48 on the bladder 46 is facing toward the bottom 16 surface of the arm rest 10.

When the arm rest 10 is placed on a supporting surface, the bladder 46 substantially conforms to the surface as fluid moves within the bladder 46. For example, as shown in FIG. 6, movement of the fluid 56 in the bladder 46 allows the bladder 46 to conform to the uneven surface 72 upon which the arm rest 10 is placed. The bladder 46 also conforms to other objects upon which it is placed such as the interior access port 40 (which as shown in FIG. 6 as a zipper). Even though the bottom surface 16 of the arm rest 10 is resting on an uneven surface 72, the foam side surface 52 of the bladder 46 maintains a relatively planar shape as it supports the bottom surface 60 of the foam pad 50. The conforming feature of the bladder 46 allows the arm rest 10 to be used on a wide variety of surfaces. The weight and rigidity of the bladder, when filled with fluid 56, aids in stabilizing the arm rest 10.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A portable arm rest comprising:

a cover having a chamber;

a flexible counterweight filled with fluid and located in a lower portion of the chamber that evenly distributes the weight of the counterweight along a bottom interior surface of the chamber for stabilizing movement of the portable arm rest when engaging a supporting surface;

a foam pad located in an upper portion of the chamber;

a beverage holder for holding a beverage container in a substantially upright position and mounted to a top surface of the cover near the centerline of the portable arm rest; and an anchor for restricting lateral and rotational movement of the portable arm rest.

2. The portable arm rest of claim 1, wherein the fluid filling the flexible counterweight is water.

3. The portable arm rest of claim 1, wherein the fluid filling the flexible counterweight is a gelatin.

* * * * *